United States Patent [19]

Marsicano

[11] Patent Number: 4,544,351

[45] Date of Patent: Oct. 1, 1985

[54] CANDLE HOLDER

[76] Inventor: Rosalind Marsicano, 933 Calle del Regalo, Green Valley, Ariz. 85614

[21] Appl. No.: 585,387

[22] Filed: Mar. 2, 1984

[51] Int. Cl.[4] ..... F23D 3/16

[52] U.S. Cl. ..... 431/288; 431/292; 362/163; 248/523; 206/588

[58] Field of Search ..... 431/289, 290, 291, 292, 431/293, 294, 295, 296, 297, 288; 362/163; 248/523, 524; 206/588, 590, 591, 594

[56] References Cited

U.S. PATENT DOCUMENTS

| | | | |
|---|---|---|---|
| 199,094 | 1/1878 | Musgrove | 362/163 |
| 441,625 | 11/1890 | Wohlmuth | 431/297 |
| 562,155 | 6/1896 | Reinhardt | 431/296 |
| 664,167 | 12/1900 | Moegling | 431/291 |
| 2,240,071 | 4/1941 | Gisolfi | 431/291 |
| 2,281,279 | 4/1942 | Fox | 431/297 |
| 3,726,632 | 4/1973 | Connolly | 431/294 X |

FOREIGN PATENT DOCUMENTS

| | | | |
|---|---|---|---|
| 77663 | 11/1918 | Austria | 431/292 |
| 44074 | 7/1965 | Fed. Rep. of Germany | 431/294 |
| 333895 | of 1936 | Italy | 431/291 |
| 17222 | 10/1889 | United Kingdom | 431/297 |
| 20428 | 11/1892 | United Kingdom | 431/293 |

*Primary Examiner*—Samuel Scott
*Assistant Examiner*—Carl D. Price
*Attorney, Agent, or Firm*—Quaintance, Murphy & Presta

[57] ABSTRACT

A candle holder formed of paper, plastic or the like which can be inserted into a hollow article such as a glass for the purpose of providing a support for a candle in the case of an emergency or when a conventional candle holder is not available. The candle holder comprises radially inwardly extending slits at the center portion thereof which define generally triangular inner tabs for frictionally engaging a candle. The inner tabs are surrounded by an annular, unslit mid-portion. An annular outer portion surrounds the mid-portion and is provided with a plurality of slits that extend generally radially outwardly from the mid-portion to the outer edge of the outer portion. The slits in the outer portion define a plurality of outer tabs that are adapted to frictionally engage the inner surface of the glass or other article in which the candle holder is inserted.

9 Claims, 2 Drawing Figures

CANDLE HOLDER

BACKGROUND OF THE INVENTION

The present invention relates to a candle holder and, more particularly, to a candle holder formed of paper or the like which can be used to support a candle in a hollow article such as a glass.

In the case of an emergency, such as a power failure, or when a conventional candle holder is not available, a need has arisen for a simple and inexpensive holder for temporarily supporting a candle in a stable desired upright position. Prior to the present invention, this need has not been met.

The present invention fulfills this need by providing a simple and inexpensive candle holder which can be formed of paper, plastic or the like and can be utilized to support a candle in a hollow article such as a glass or the like.

SUMMARY OF THE INVENTION

The candle holder of the present invention may be easily formed of a substantially flat blank of paper, plastic or the like which can be inserted into a hollow object such as a glass for temporarily supporting a candle in an upright position in the glass in the case of an emergency or when a conventional candle holder is not available.

Preferably, the candle holder comprises radially inwardly extending slits at the center portion thereof which define generally triangular inner tabs for frictionally engaging a candle. The inner tabs are surrounded by an annular, unslit mid-portion. An annular outer portion surrounds the mid-portion and is provided with a plurality of slits that extend generally radially outwardly from the mid-portion to the outer edge of the outer portion. The slits in the outer portion define a plurality of outer tabs that are adapted to frictionally engage the inner surface of the glass or other article in which the candle holder is inserted.

Because of its simple flat construction, one or more of the candle holders of the present invention can be conveniently stored in a number of suitable or desired locations for use in the case of an emergency or when a conventional candle holder is not available. Also the candle holder is constructed to support candles of different thicknesses and to fit into glasses or other hollow objects of different widths.

DESCRIPTION OF THE PREFERRED EMBODIMENT

Figure 1:
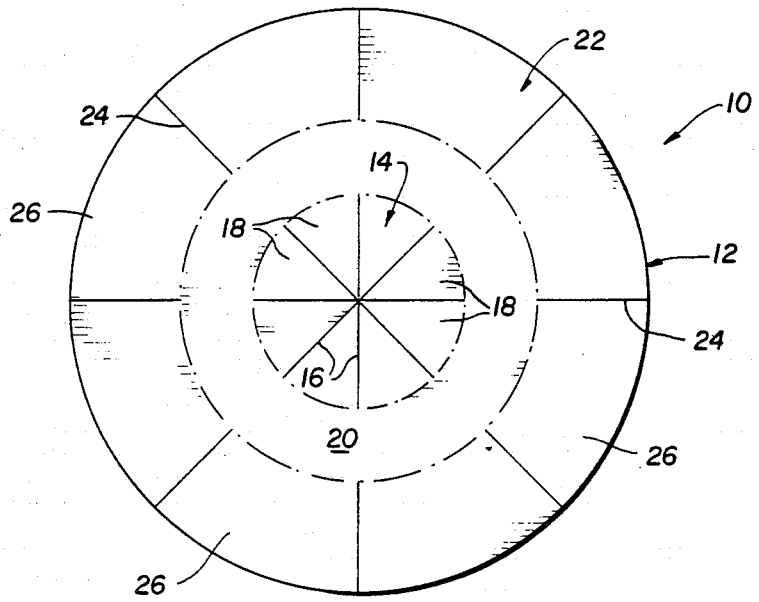
FIG. 1 is a plan view of a candle holder constructed in accordance with the principles of the present invention.

As shown in FIG. 1, the candle holder 10 of the present invention preferably is formed of a substantially flat blank 12 of paper, cardboard, plastic or the like. Within the principles of the present invention, the blank 12 may be formed of any suitable material. Preferably the blank 12 is of circular shape, although it could be of other shapes depending on the shape of the hollow article into which it is to be inserted.

The blank 12 comprises a center portion 14 having generally radially inwardly extending slits 16 therethrough which define a plurality of generally triangular, flexible inner tabs 18 adapted for frictional engagement with a candle in a manner to be more specifically described hereinafter. A generally annular unslit mid-portion 20 surrounds the center portion 14.

A generally annular outer portion 22 surrounds the mid-portion 20 and is provided with a plurality of slits 24 that extend generally radially outwardly from the mid-portion 20 to the outer edge of the outer portion 22. The slits 24 define a plurality of flexible outer tabs 26 that are adapted to frictionally engage the inner surface of a glass or other hollow article in which the holder 10 is inserted.

Figure 2:
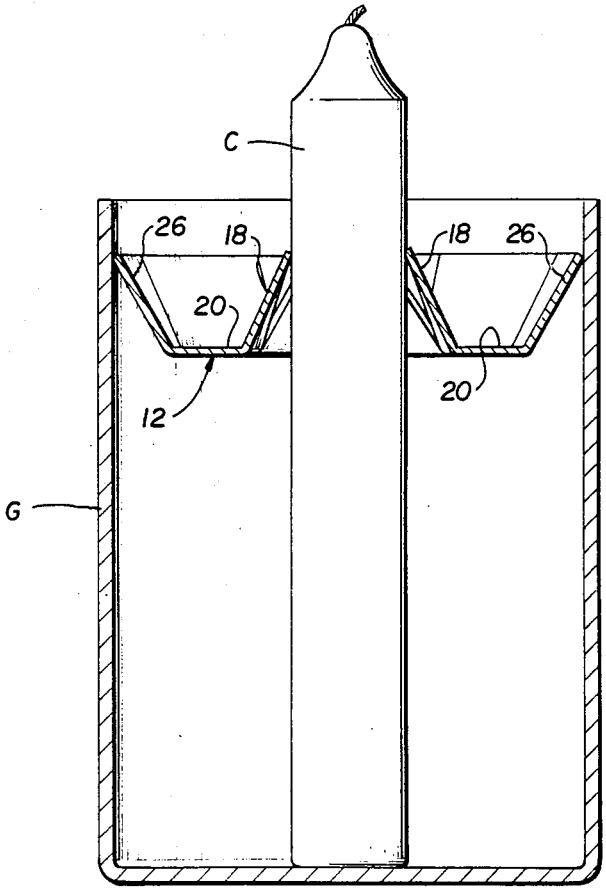
FIG. 2 is an elevational view of the candle holder positioned within a glass or the like and supporting a candle therein.

Referring to FIG. 2 of the drawing, in the use of the candle holder 10, a candle C is first inserted through the center portion 14 of the blank 12 in frictional engagement with the inner tabs 18. Thereafter, the candle C and holder 10 are positioned within a hollow article such as a glass G with the outer tabs 26 in frictional engagement with the inner surface thereof to support the candle C in an upright position within the glass in the manner shown in FIG. 2.

Because of its construction, it will be readily seen that the candle holder 10 of the present invention can be used with candles and glasses or other hollow articles of various sizes and shapes.

What I claim is:

1. In combination, an upwardly extending hollow article having an upstanding side wall, a candle disposed within said hollow article, said candle having a side surface, and a holder supporting said candle in an upright position within said hollow article in spaced relation to said upstanding side wall, said holder being formed from a substantially flat blank of a unitary piece of flexible material having:

a center portion having a plurality of inwardly extending inner tabs in frictional engagement with said side surface of said candle, said inner tabs being bent upwardly by the candle extending therebetween;

a mid-portion surrounding said center portion; and an outer portion surrounding said mid-portion and having a pluality of outwardly extending outer tabs wherein the outer perpheral edge of said outer portion is in frictional engagement with the inner surface of said side wall of said hollow article to support said candle in an upright position therein, said outer tabs bent upwardly to engage said side wall;

said mid-portion being substantially annular and flat so as to separate said inner fabs from said outer tabs.

2. The holder of claim 1 wherein said center portion comprises a plurality of generally radially inwardly extending slits which define said inner tabs.

3. The holder of claim 2 wherein said inner tabs are of a generally triangular shape.

4. The holder of claim 2 wherein said outer portion comprises a plurality of generally radially outwardly extending slits which define said outer tabs.

5. The holder of claim 1 wherein said inner tabs are bendable substantially at the junction between said center portion and said mid-portion.

6. The holder of claim 1 wherein said outer tabs are bendable substantially at a junction between said mid-portion and said outer portion.

7. The holder of claim 2 wherein said inwardly extending slits are substantially uniformly spaced throughout said center portion.

8. The holder of claim 4 wherein said outwardly extending slits are substantially uniformly spaced throughout said outer portion.

9. The holder of claim 11 wherein said blank is formed of paper.

* * * * *